US007170454B2

(12) United States Patent
Tefiku

(10) Patent No.: US 7,170,454 B2
(45) Date of Patent: Jan. 30, 2007

(54) ANTENNA ARRANGEMENT

(75) Inventor: Faton Tefiku, San Diego, CA (US)

(73) Assignee: Nokia Corporation, Espoo (FI)

( * ) Notice: Subject to any disclaimer, the term of this patent is extended or adjusted under 35 U.S.C. 154(b) by 25 days.

(21) Appl. No.: 11/096,006

(22) Filed: Mar. 30, 2005

(65) Prior Publication Data

US 2006/0220964 A1 Oct. 5, 2006

(51) Int. Cl.
*H01Q 1/24* (2006.01)

(52) U.S. Cl. ..... 343/702; 343/895; 343/901

(58) Field of Classification Search ..... 343/702, 343/895, 900, 901, 852, 853
See application file for complete search history.

(56) References Cited

U.S. PATENT DOCUMENTS 5,650,789 A * 7/1997 Elliott et al. ..... 343/895
5,969,684 A * 10/1999 Oh et al. ..... 343/702
6,052,089 A 4/2000 Eggleston ..... 343/702
6,496,150 B1 12/2002 Li et al. ..... 343/702
6,531,986 B2 * 3/2003 Saito ..... 343/900
6,738,603 B1 5/2004 Saito ..... 455/90.1
6,753,827 B2 * 6/2004 Oshiyama et al. ..... 343/702

FOREIGN PATENT DOCUMENTS

EP 0617520 A2 9/1994

* cited by examiner

*Primary Examiner*—Tan Ho
*Assistant Examiner*—Ephrem Alemu
(74) *Attorney, Agent, or Firm*—Harrington & Smith, LLP

(57) ABSTRACT

An antenna arrangement including a first matching circuit; a second matching circuit; a first antenna connected to the first matching circuit; a second antenna, moveable with respect to the first antenna, between an extended position in which it is connected to the first matching circuit and a non-extended position in which it forms a couple between the first antenna and the second matching circuit, wherein the second antenna has an impedance that is brought towards a first impedance at a first operational frequency band when the second antenna is moved into the extended position and the first antenna has an impedance which is brought towards the first impedance at a first operational frequency band when the second antenna is moved into the non-extended position.

17 Claims, 4 Drawing Sheets

ANTENNA ARRANGEMENT

FIELD OF THE INVENTION

Embodiments of the present invention relate to an antenna arrangement. In particular, they relate to an antenna arrangement for a portable telephone.

BACKGROUND TO THE INVENTION

Electronic communication devices such as portable phones usually comprise at least one antenna to transmit and receive electromagnetic signals. Antennas, which are external to the electronic communication device, tend to provide superior radiated performance to antennas which are internal to the electronic communication device. External antennas are often retractable into the electronic communication device to reduce the size of the device and to reduce the likelihood that the antenna may be damaged by a user.

When an external antenna is in a retracted position, it may be unable to transmit and/or receive electromagnetic signals. Therefore, electronic communication devices which comprise an external antenna usually also comprise a second antenna so that when the external antenna is retracted, the second antenna may transmit and receive electromagnetic signals.

One problem associated with electronic communication devices which comprise more than one antenna is that the antennas interfere with one another, either through direct electrical connection or through electromagnetic coupling.

Another problem associated with electronic communication devices which comprise more than one antenna is that it is difficult to achieve similar impedances in each of the antennas over more than one operational frequency band using the same feeding circuit.

A further problem associated with electronic communication devices which comprise more than one antenna and have a plurality of physical configurations (e.g. a portable fold telephone or a portable slide telephone) is that the impedance of each of the antennas changes significantly depending on the physical configuration of the electronic communication device. Consequently, the radiative performance of each of the antennas changes significantly depending on the physical configuration of the electronic communication device.

Some antenna arrangements address the problem of electromagnetic interference by providing physical separation between the radiating portions of the antennas. One disadvantage associated with this solution is that in order to provide physical separation, external antennas usually have a long insulating cap and consequently, a reduced electrical length which reduces the radiation performance of the external antenna. If a person wishes to increase the electrical length of the external antenna it may be necessary to increase the size of the electronic communication device to ensure that there is physical separation between the radiating portions of the antennas.

Other antenna arrangements address the problem by using switches (mechanical or electrical) to disable the external antenna when it is retracted and to disable the internal antenna when the external antenna is extended. One disadvantage associated with this solution is that switches are usually expensive. Furthermore, mechanical switches are usually unreliable and electrical switches may introduce non-linearity problems.

Therefore, it is desirable to provide an alternative antenna arrangement for electronic communication devices.

BRIEF DESCRIPTION OF THE INVENTION

According to one embodiment of the invention there is provided An antenna arrangement comprising: a first matching circuit; a second matching circuit; a first antenna connected to the first matching circuit; a second antenna, moveable with respect to the first antenna, between an extended position in which it is connected to the first matching circuit and a non-extended position in which it forms a couple between the first antenna and the second matching circuit, wherein the second antenna has an impedance that is brought towards a first impedance at a first operational frequency band when the second antenna is moved into the extended position and the first antenna has an impedance which is brought towards the first impedance at a first operational frequency band when the second antenna is moved into the non-extended position.

One advantage provided by embodiments of the present invention is that it is not necessary to physically separate the first and second antennas in order to reduce electromagnetic interference between them since their impedances are controlled by the first and second matching circuits. A further advantage is that it is not necessary to use expensive mechanical or electrical switches to enable either the first antenna or second antenna to receive electromagnetic signals.

The second antenna may have an impedance at the first operational frequency band which is significantly shifted from the first impedance when in the non-extended position. The first antenna may have an impedance at the first operational frequency band which is significantly shifted from the first impedance when the second antenna is in the extended position.

The second antenna may have a length, a portion of which resonates in order to transmit and receive electromagnetic signals. The length of the second antenna and the portion of the second antenna may be substantially the same.

The antenna arrangement may further comprise a connector for connecting the first matching circuit to the first antenna and for connecting the second antenna to the first matching circuit when the second antenna is in the extended position.

The second antenna may comprise an electrical insulator for preventing electrical connection between the second antenna and the electrical connector when the second antenna is in the non-extended position.

The connector may comprise an electrical conductor and a feed contact. The feed contact may be electrically connected to the first matching circuit and the electrical conductor. The electrical conductor may be connected to the first antenna and is connectable with the second antenna when the second antenna is in the extended position.

The first antenna may be a meander antenna. The second antenna may be a whip antenna.

The whip antenna may be telescopically moveable between the first position and the second position.

The antenna arrangement may comprise a housing defining a through-aperture having a volume.

The second antenna may be moveable within the through-aperture. When the second antenna is in the non-extended position, a conductive portion of the second antenna may occupy at least a portion of the volume of the through-aperture.

According to another embodiment of the present invention there is provided an electronic device comprising an antenna arrangement as described in the preceding paragraphs.

According to a further embodiment of the present invention there is provided a portable telephone comprising an antenna arrangement as described in the preceding paragraphs.

According to another embodiment of the present invention there is provided an antenna arrangement comprising: a first matching circuit; a first antenna connected to the first matching circuit; a second matching circuit; a second antenna, moveable with respect to the first antenna, between an extended position and a non-extended position, and connectable to the second matching circuit when in the non-extended position, the first antenna being coupled to the second antenna when the second antenna is in the non-extended position, wherein the first antenna has an impedance which is brought towards a first impedance at a first operational frequency band when the second antenna is moved to the non-extended position and has an impedance which is shifted away from the first impedance when the second antenna is moved to the extended position.

According to a further embodiment of the present invention there is provided an antenna arrangement comprising: a first matching circuit; a second matching circuit; a first antenna connected to the first matching circuit; and a second antenna moveable between an extended position and a non-extended position, wherein the antenna arrangement has a first configuration in which the second antenna is extended and a second configuration in which the second antenna is retracted and wherein in the first configuration the first antenna and the second antenna are both connected to the first matching circuit and wherein in the second configuration the second antenna is disconnected from the first matching circuit and connected to the second matching circuit and the first antenna is connected to the first matching circuit and coupled to the second matching circuit via the second antenna.

According to another embodiment of the present invention there is provided an antenna arrangement comprising: a first matching circuit; a second matching circuit; a first antenna connected to the first matching circuit; a second antenna, moveable with respect to the first antenna, between an extended position in which it is connected to the first matching circuit and a non-extended position in which it forms a couple between the first antenna and the second matching circuit, wherein the second antenna is in tune when the second antenna is in the extended position and the first antenna is in tune when the second antenna is in the non-extended position.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
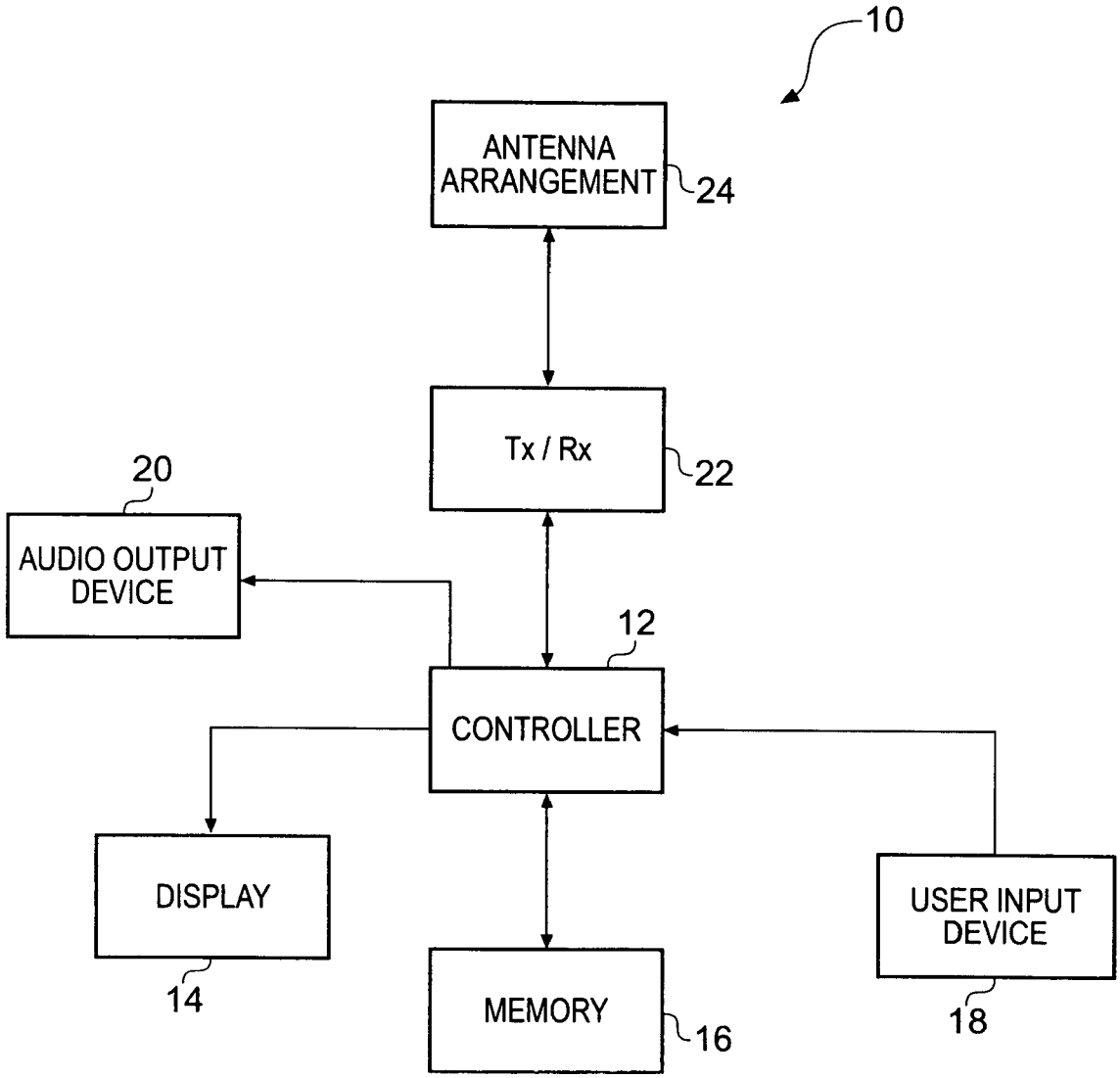
FIG. 1 illustrates a schematic diagram of one embodiment of an electronic communication device.

The Figures illustrate an antenna arrangement 24 comprising: a first matching circuit 26; a second matching circuit 28; a first antenna 30 connected to the first matching circuit 26; a second antenna 32, moveable with respect to the first antenna 30, between an extended position in which it is connected to the first matching circuit 26 and a non-extended position in which it forms a couple between the first antenna 30 and the second matching circuit 28, wherein the second antenna 32 has an impedance that is brought towards a first impedance at a first operational frequency band when the second antenna 32 moved into the extended position and the first antenna 30 has an impedance which is brought towards the first impedance at a first operational frequency band when the second antenna 32 is moved into the non-extended position.

In more detail, FIG. 1 illustrates a schematic diagram of an electronic communication device 10 according to one embodiment of the present invention. The electronic communication device comprises a controller 12, a display 14, a memory 16, a user input device 18, an audio output device 20, a transceiver 22 and an antenna arrangement 24.

The electronic communication device 10 is any suitable device that may transmit and receive electromagnetic signals. In particular, it may be any suitable device that may transmit and receive radio frequency signals. The electronic communication device 10 may be a portable telephone, such as a mobile cellular telephone, a personal digital assistant, a personal computer or a console. In this embodiment, the electronic communication device 10 illustrated is a mobile cellular telephone.

The display 14 is coupled to the controller 12 for receiving and displaying data. The display may be any suitable display capable of displaying data and may be in particular a liquid crystal display (LCD), a thin film transistor display (TFT), a monitor or a television.

The controller 12 is electrically coupled to control the display 14 and read to and write from the memory 16. The memory 16 may be any suitable memory and may, for example be permanent built-in memory such as flash memory or it may be a removable memory such as a hard disk, secure digital (SD) card or a micro-drive.

The controller 12 is electrically coupled to the user input device 18 from which it receives command signals. The user input device 18 may be any suitable user input device and may, for example be a keypad, mouse, stylus or trackball.

The controller 12 is electrically coupled to the antenna arrangement 24 via the transceiver 22 to transmit to and receive from other electronic communication devices. In one embodiment, the controller 12 is electrically coupled to the antenna arrangement 24 via the transceiver 22 to transmit data to and receive data from other electronic communication devices. For example, the controller 12 may read data from the memory 16 and provide it to the transceiver 22 which codes and modulates the data so that it is suitable for transmission. The coded data is subsequently transmitted to another electronic communication device via the antenna arrangement 24 as an electromagnetic signal. The electromagnetic signal transmitted from the antenna arrangement 24 is typically a radio frequency signal having a frequency within a first operational frequency band.

The antenna arrangement 24 may receive an electromagnetic signal which is subsequently provided to the transceiver 22. The transceiver 22 demodulates and decodes the signal into data which is subsequently provided to the controller 12 and stored in the memory 16. The electromagnetic signal received by the antenna arrangement 24 is typically a radio frequency signal having a frequency within the first operational frequency band.

In this embodiment, the transceiver 22 transmits and receives electromagnetic signals at different frequencies. Examples, of such an embodiment are CDMA CELL (824 MHz to 894 MHz) and CDMA PCS (1850 MHz to 1990 MHz) which use Code Division Multiple Access (CDMA). In another embodiment, the frequency of the transmitted electromagnetic signal is the same as the frequency of the received electromagnetic signal. The transceiver 22 transmits and receives electromagnetic signals in alternate time slots. Examples of such an embodiment are GSM 900 MHz and GSM 1800 MHz which use Time Division Multiple Access (TDMA).

In one embodiment, the antenna arrangement 24 can transmit and receive electromagnetic signals having frequencies in a plurality of operational frequency bands. For example, in one embodiment the antenna arrangement 24 can transmit and receive electromagnetic signals in two frequency bands, CDMA CELL and CDMA PCS. In another embodiment, the antenna arrangement can transmit and receive electromagnetic signals in the GSM 900 and GSM 1800 bands.

The antenna arrangement 24 will now be discussed in greater detail with reference to FIGS. 2 and 3.

Figure 2:
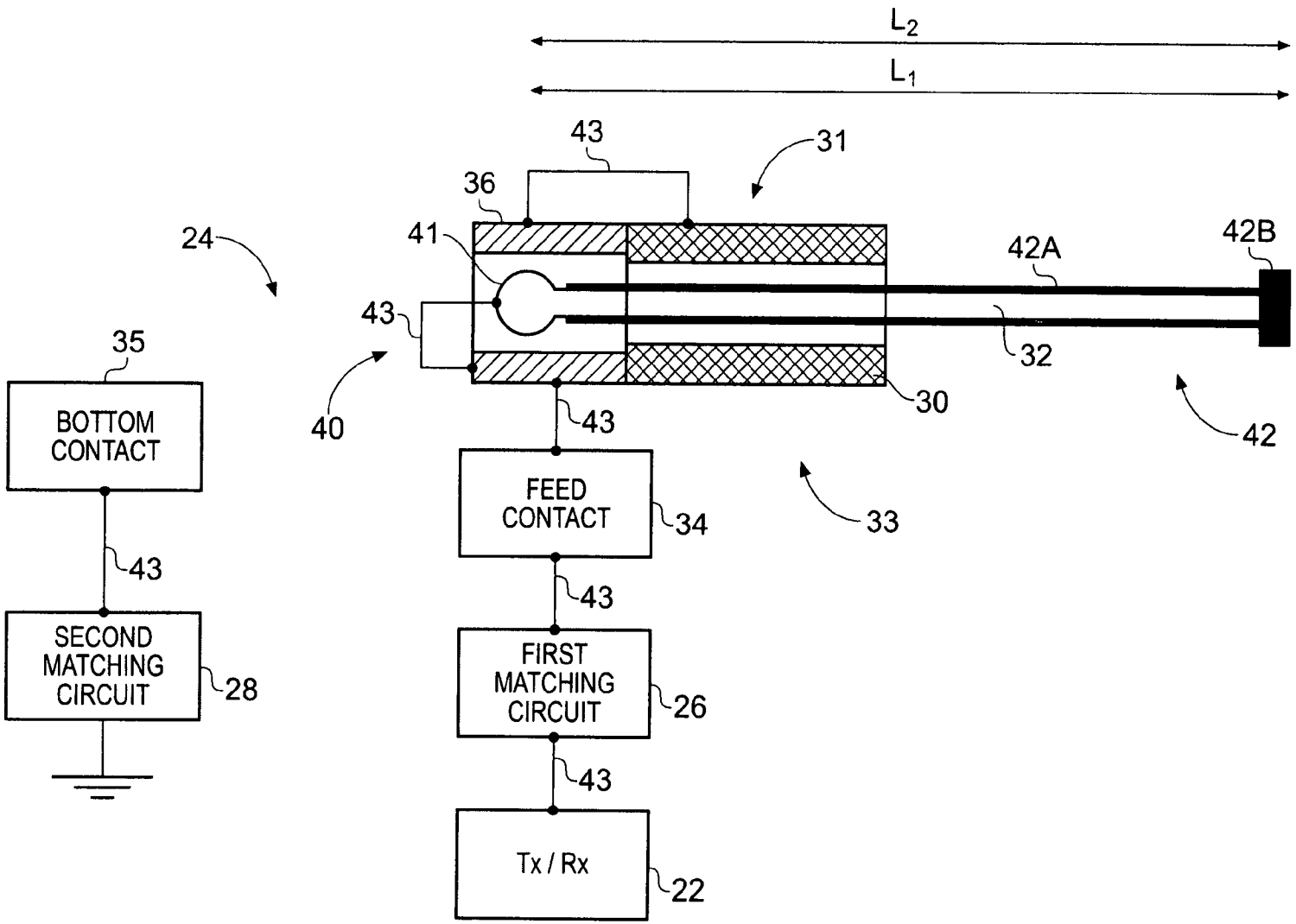
FIG. 2 illustrates a schematic diagram of one embodiment of an antenna arrangement in an extended configuration.

FIG. 2 illustrates a schematic diagram of one embodiment of an antenna arrangement 24 in an extended configuration. The antenna arrangement 24 comprises a first matching circuit 26, a second matching circuit 28, a first antenna 30 which is in this embodiment a meander antenna, a second antenna 32 which is in this embodiment a whip antenna, a connector 33 comprising a feed contact 34 and an electrically conducting tube 36, and a bottom contact 35. The whip antenna 32 comprises an electrical insulator 42 and an electrical contact 41. The electrical insulator 42 includes a whip cover 42A and a whip cap 42B.

Figure 3:
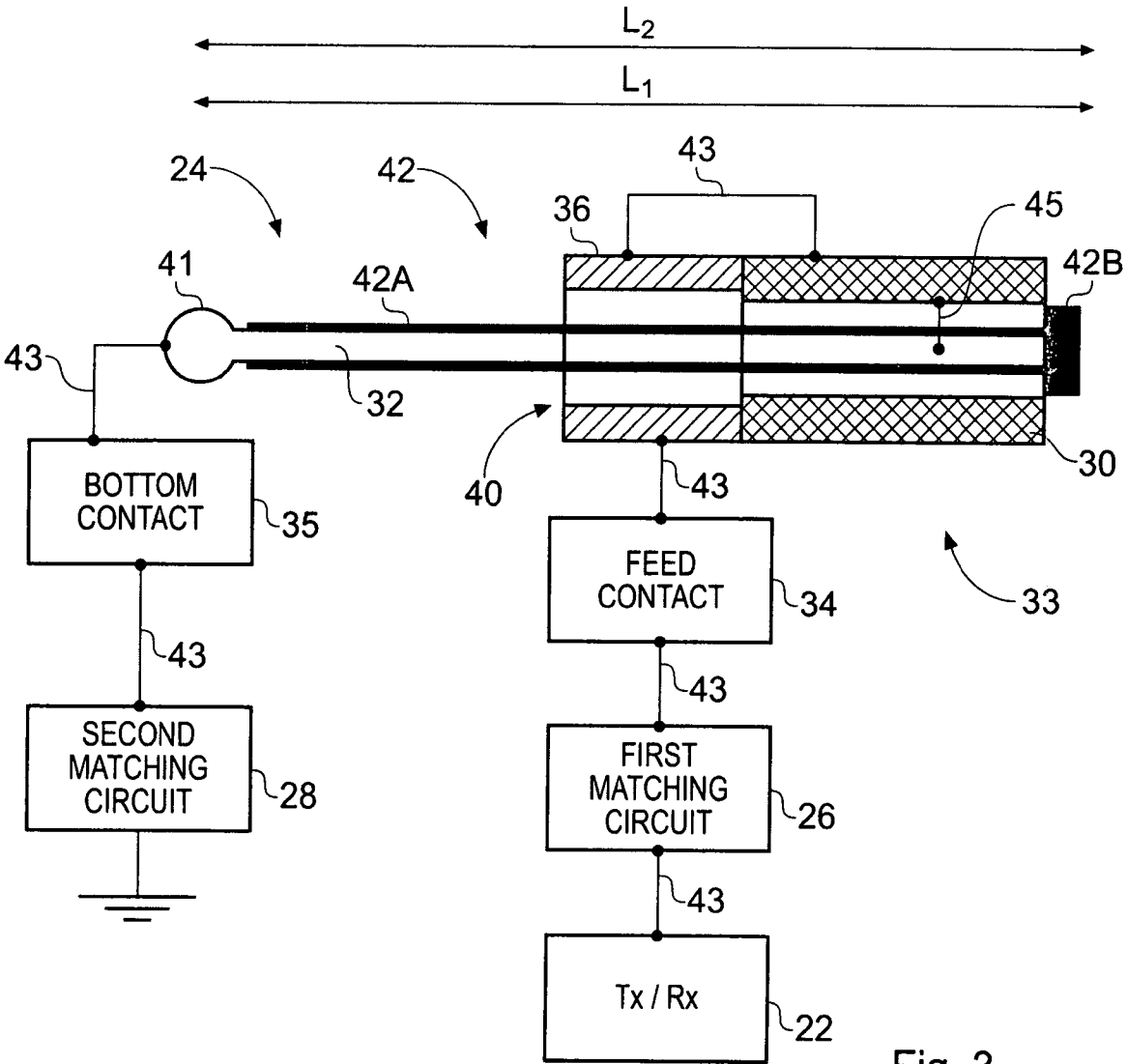
FIG. 3 illustrates a schematic diagram of the antenna arrangement illustrated in FIG. 2 in a non-extended configuration.

In FIGS. 2 and 3, an electrical connection between two features is illustrated by a single line that extends between the two features. The single lines which identify the electrical connections have been provided with the reference numeral 43.

The transceiver 22 is electrically connected to the first matching circuit 26. The first matching circuit 26 is electrically connected to the feed contact 34 which is in turn electrically connected to the electrically conducting tube 36. The electrically conducting tube 36 is also electrically connected to the meander antenna 30.

The second matching circuit 28 is electrically connected between ground (e.g. a printed wiring board of the electronic communication device 10) and the bottom contact 35.

The electrically conducting tube 36 is in this embodiment a metallic tube. The metallic tube 36 and the meander antenna 30 comprise a through-aperture 40, having a volume, in which the whip antenna 32 is moveable between an extended position and a non-extended position relative to the meander antenna 30. In one embodiment, the metallic tube 36 and the meander antenna 30 provide a housing 31 for the whip antenna 32.

The whip cover 42A and the whip cap 42B of the electrical insulator 42 also provide protection against the environment (e.g. rain) for the whip antenna 32 and may comprise plastic. Additionally, they may reduce the likelihood of wear of the whip antenna 32 when it is being moved from an extended position to a non-extended position.

In one embodiment, the feed contact 34 is a spring type clip which is physically connected to the metallic tube 36 to contact an antenna pad (not illustrated) on the printed wiring board. Alternatively, the feed contact 34 may be physically connected to the antenna pad to contact the metallic tube 36.

When the whip antenna 32 is in the extended position (FIG. 2), it is electrically connected via the electrical contact 41, metallic tube 36 and feed contact 34 to the first matching circuit 26 and is electrically disconnected from the second matching circuit 28. In the extended position (FIG. 2), the whip antenna 32 has an impedance which is brought towards a first impedance (at 50Ω when measured at the interface between the whip antenna 32 and the transceiver 22) at a first operational frequency band and is therefore able to efficiently transmit/receive electromagnetic signals having a frequency within the first operational frequency band. The whip antenna 32 comprises a conductive portion which, when in the extended position, occupies at least a portion of the volume defined by the through-aperture 40. The meander antenna 30 is also connected to the first matching circuit 26 via the metallic tube 36 and feed contact 34. It has an impedance which is significantly different to the first impedance and is consequently unable to efficiently transmit/receive electromagnetic signals having a frequency within the operational frequency band. The meander antenna 30 also resonates with a frequency outside of the first operational frequency band. There is consequently no significant interference between the whip antenna 32 and the meander antenna 30.

In this embodiment, the first impedance is a design impedance. A design impedance is an impedance (usually 50Ω) which allows an antenna to transmit and receive electromagnetic signals having a frequency within a desired frequency band or bands.

In this embodiment, the first operational frequency band is one of a plurality of frequency bands in which electromagnetic signals can be transmitted to and received from the antenna arrangement 24. The first operational frequency band may be, for example, a licensed frequency band, e.g. CDMA CELL or CDA PCS.

FIG. 3 illustrates a non-extended configuration. Where the features illustrated in FIG. 3 are similar to those features illustrated in FIG. 2, the same reference numerals have been used. In more detail, FIG. 3 illustrates that the whip antenna 32 is retracted relative to the meander antenna 30 so that it does not extend from the meander antenna 30.

When the whip antenna 32 is fully retracted, the electrical contact 41 is electrically connected to the second matching circuit 28 via the bottom contact 35. The whip antenna 32 is electrically disconnected from the first matching circuit 26. The whip antenna 32 is prevented from making electrical contact with the metallic tube 36 by the electrical insulator 42 (in this embodiment by the whip cover 42A). The retracted whip antenna 32 which is now connected to the second matching circuit 28 and not the first matching circuit 26, has an impedance which is shifted away from the first impedance and is consequently unable to efficiently transmit/receive electromagnetic signals having a frequency within the operational frequency band. The conductive portion of the whip antenna 32, when in the retracted position, occupies at least a portion of the volume defined by the through-aperture 40. In one embodiment, the conductive portion of the whip antenna 32 occupies a substantial portion of the volume defined by the through-aperture 40.

The meander antenna 30 is still electrically connected to the first matching circuit 26 as in the extended position but it is also electromagnetically coupled (indicated by a line with the reference numeral 45) to the second matching circuit 28 via the whip antenna 32. The whip antenna 32 does not make electrical contact with the meander antenna 30 because of the electrical insulator 42. However, it is in close proximity to the meander antenna 30 and there is electromagnetic coupling between the antennas. The impedance of the meander antenna 30 is brought towards the first impedance (at 50Ω, measured at the interface between the meander antenna 30 and the transceiver 22) when the whip antenna 32 is in the non-extended position by the coupling to the second matching circuit 28. Consequently, the meander antenna 30 is able to efficiently transmit/receive electromagnetic signals having a frequency within the operational frequency band.

It is known in the art of antenna design that matching circuits may be used to change the impedance of an antenna. If the impedance of an antenna is correct, the antenna is able to efficiently transmit/receive electromagnetic signals having a frequency within a desired operational frequency band. If the impedance of an antenna is incorrect, the antenna is unable to efficiently transmit/receive electromagnetic signals having a frequency within the desired operational frequency band.

As described above and in summary, the matching circuits 26 and 28 are designed so that the first matching circuit 26 by itself provides the whip antenna 32 with an impedance which is brought towards the first impedance and the meander antenna 30 with an impedance which is shifted away from the first impedance. The second matching circuit 28 is designed so that by itself it provides the whip antenna 32 with an impedance which is shifted away from the first impedance and in combination with the first matching circuit 26 provides the meander antenna 30 with an impedance which is brought towards the first impedance. The matching circuits 26 and 28 may be designed by measuring s-parameters of the antenna system with the whip antenna 32 in the extended and non-extended positions and can be optimised by using software such as APLAC, Agilent ADS and Ansoft Designed.

The antenna arrangement 24 provides an advantage because when the whip antenna 32 is in the extended position (illustrated in FIG. 2) it is able to efficiently transmit/receive electromagnetic signals in the operational frequency band and the meander antenna 30 is unable to efficiently transmit/receive electromagnetic signals in the operational frequency band. When the whip antenna 32 is in the non-extended\retracted position (illustrated in FIG. 3), the whip antenna 32 is unable to efficiently transmit/receive electromagnetic signals in the operational frequency band and the meander antenna 30 is able to efficiently transmit/receive electromagnetic signals in the operational frequency band.

Since only one antenna is able to efficiently transmit/receive electromagnetic signals in either the extended or non-extended\retracted position, the meander antenna 30 does not interfere with\load the whip antenna 32 when the whip antenna 32 is in the extended position. Consequently, it is not necessary to provide physical separation (for example, by having a long whip cap) between the radiating portions of the antennas to reduce interference between them. If the whip antenna is required to have a particular electrical length, this advantage may help to reduce the size of the electronic communication device 10 since the size of the whip cap 42B can be minimised and consequently, less space may be required for the antenna arrangement 24. Nor is it necessary to provide switches (mechanical or electrical) for enabling\disabling the antennas depending on whether the whip antenna 32 is in an extended position or a non-extended position. Since switches are usually expensive, this may help to reduce the cost of the electronic communication device 10.

The antenna arrangement 24 also provides an advantage in that the conductive portion of the whip antenna 32 occupies at least a portion of the volume defined by through-aperture 40 of housing 31. In prior art arrangements the conductive portion of the whip antenna has to be located away from the housing to reduce electromagnetic interference between the whip antenna and a second antenna, located in the housing. Consequently, embodiments of the present invention provide an advantage in that the antenna arrangement 24 may occupy less space since it is not necessary to locate the conductive portion of the whip antenna 32 away from the housing 31 when the whip antenna is in the retracted position.

The antenna arrangement 24 also provides an advantage in that when it is the antenna arrangement for a portable fold telephone or a portable slide telephone (telephones which have a plurality of physical configurations), its radiative performance is not substantially effected by the configuration of the telephone, i.e. the configuration of the telephone does not substantially alter the impedances of the antenna arrangement.

Figure 4A:
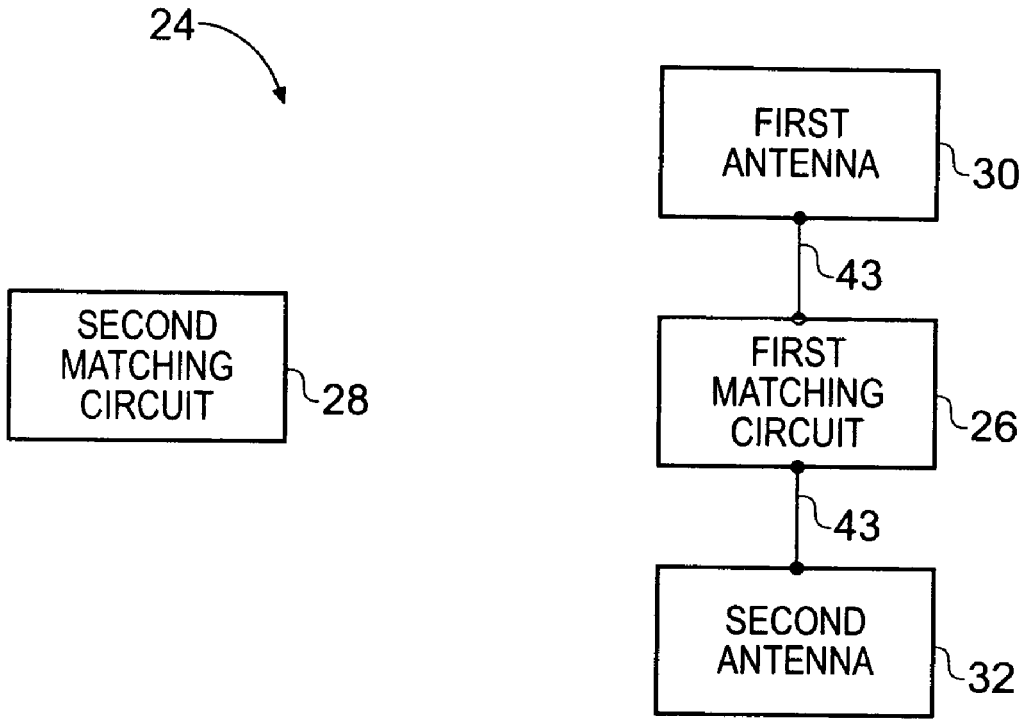
FIG. 4A illustrates a schematic diagram of the electrical connections of the antenna arrangement illustrated in FIG. 2.

By way of a summary, FIG. 4A illustrates the electrical connections within antenna arrangement 24 when the whip antenna 32 is in the extended position. The first matching circuit 26 is electrically connected 43 to the meander antenna 30 and the whip antenna 32. The second matching circuit 28 is disconnected from the whip antenna 32. The whip antenna 32 is able to transmit/receive electromagnetic signals within the desired operational frequency band(s) and the meander antenna 30 is unable to transmit/receive electromagnetic signals within the desired operational frequency band(s).

Figure 4B:
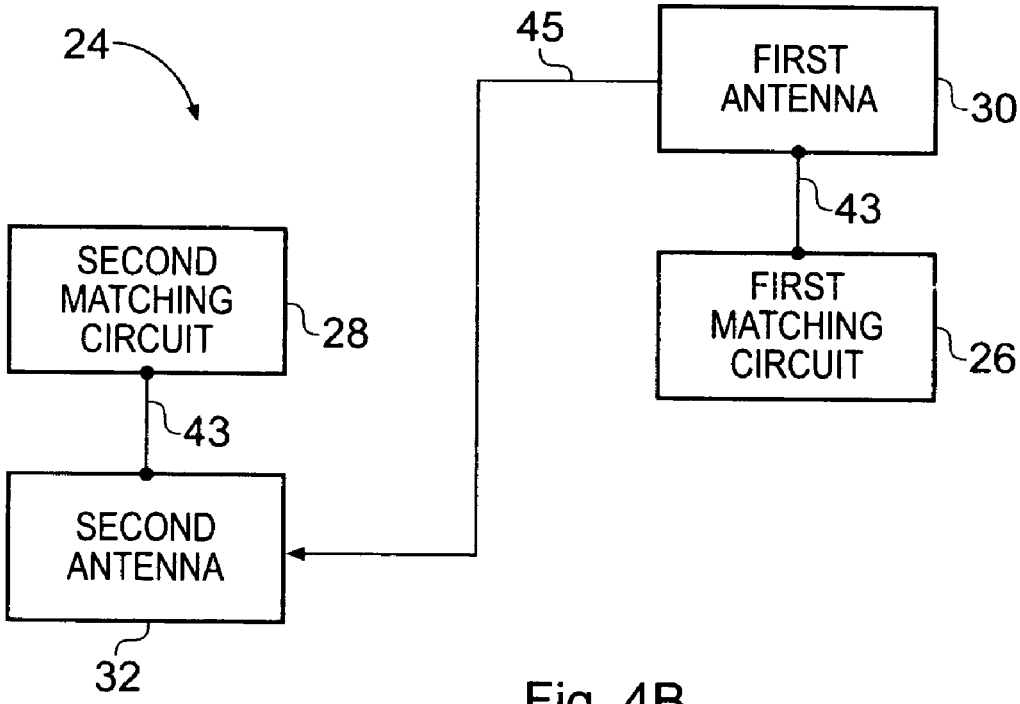
FIG. 4B illustrates a schematic diagram of the electrical connections of the antenna arrangement illustrated in FIG. 3.

FIG. 4B illustrates the electrical connections and electromagnetic coupling within the antenna arrangement 24 when the whip antenna 32 is in the non-extended position. The first matching circuit 26 is electrically connected 43 to the meander antenna 30 and electrically disconnected from the whip antenna 32. The second matching circuit 28 is electrically connected 43 to the whip antenna 32. The second matching circuit is coupled to the meander antenna 30 via electromagnetic coupling 45 between the whip antenna 32 and the meander antenna 30. The whip antenna 32 is unable to transmit/receive electromagnetic signals within the desired operational frequency band(s) and the meander antenna 30 is able to transmit/receive electromagnetic signals within the desired operational frequency band(s).

Although embodiments of the present invention have been described in the preceding paragraphs with reference to various examples, it should be appreciated that modifications to the examples given can be made without departing from the spirit and scope of the invention. For example, the whip antenna 32 may be telescopically extendable between the extended position and the non-extended\retracted position. The first antenna 30 may be any type of internal antenna and may for example be a coil antenna.

Although embodiments have been described with reference to shift of impedance at a desired operational frequency band, they can also be viewed as a shift of frequency (tuning\detuning) at a desired impedance range. For example, the whip antenna 32 is in tune (having a frequency within an operational frequency band) when it is in the extended position and connected to the first matching circuit 26 (see FIG. 2). The meander antenna 30 is detuned (having a frequency outside of the operational frequency band) when the whip antenna 32 is in the extended position and it is connected to the first matching circuit 26 (see FIG. 2). The whip antenna 32 is detuned when it is in the non-extended\retracted position and connected to the second matching circuit 28 (see FIG. 3). The meander antenna 30 is in tune when the whip antenna 32 is in the non-extended\retracted position and it is connected to the first matching circuit 26 and coupled to the second matching circuit 28 via the whip antenna 32 (see FIG. 3).

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An antenna arrangement comprising:

a first matching circuit;

a second matching circuit;

a first antenna connected to the first matching circuit;

a second antenna, moveable with respect to the first antenna, between an extended position in which it is connected to the first matching circuit and a non-extended position in which it forms a couple between the first antenna and the second matching circuit, wherein the second antenna has an impedance that is brought towards a first impedance at a first operational frequency band when the second antenna is moved into the extended position and the first antenna has an impedance which is brought towards the first impedance at the first operational frequency band when the second antenna is moved into the non-extended position.

2. An antenna arrangement as claimed in claim 1, wherein the second antenna has an impedance at the first operational frequency band which is significantly shifted from the first impedance when in the non-extended position.

3. An antenna arrangement as claimed in claim 1, wherein the first antenna has an impedance at the first operational frequency band which is significantly shifted from the first impedance when the second antenna is in the extended position.

4. An antenna arrangement as claimed in claim 1, wherein the second antenna has a length, a portion of which resonates in order to transmit and receive electromagnetic signals, the length of the second antenna and the portion of the second antenna are substantially the same.

5. An antenna arrangement as claimed in claim 1, further comprising a connector which connects the first matching circuit to the first antenna and for connecting the second antenna to the first matching circuit when the second antenna is in the extended position.

6. An antenna arrangement as claimed in claim 5, wherein the second antenna comprises an electrical insulator for preventing electrical connection between the second antenna and the electrical connector when the second antenna is in the non-extended position.

7. An antenna arrangement as claimed in claim 5, wherein the connector comprises an electrical conductor and a feed contact, wherein the feed contact is electrically connected to the first matching circuit and the electrical conductor, and the electrically conductor is connected to the first antenna and is connectable with the second antenna when the second antenna is in the extended position.

8. An antenna arrangement as claimed in claim 1, wherein the first antenna is a meander antenna.

9. An antenna arrangement as claimed in claim 1, wherein the second antenna is a whip antenna.

10. An antenna arrangement as claimed in claim 9, wherein the whip antenna is telescopically moveable between the first position and the second position.

11. An antenna arrangement as claimed in claim 1, further comprising a housing defining a through-aperture having a volume, wherein the second antenna is moveable within the through-aperture, and when the second antenna is in the non-extended position, a conductive portion of the second antenna occupies at least a portion of the volume of the through-aperture.

12. An electronic device comprising an antenna arrangement as claimed in claim 1.

13. A portable telephone comprising an antenna arrangement as claimed in claim 1.

14. An antenna arrangement comprising:

a first matching circuit;

a first antenna connected to the first matching circuit a second matching circuit;

a second antenna, moveable with respect to the first antenna, between an extended position and a non-extended position, and connectable to the second matching circuit when in the non-extended position, the first antenna being coupled to the second antenna when the second antenna is in the non-extended position, wherein the first antenna has an impedance which is brought towards a first impedance at a first operational frequency band when the second antenna is moved to the non-extended position and has an impedance which is shifted away from the first impedance when the second antenna is moved to the extended position.

15. An antenna arrangement comprising:

a first matching circuit;

a second matching circuit;

a first antenna connected to the first matching circuit; and a second antenna, moveable between an extended position and a non-extended position, wherein the antenna arrangement has a first configuration in which the second antenna is extended and a second configuration in which the second antenna is retracted and wherein in the first configuration the first antenna and the second antenna are both connected to the first matching circuit and wherein in the second configuration the second antenna is disconnected from the first matching circuit and connected to the second matching circuit and the first antenna is connected to the first matching circuit and coupled to the second matching circuit via the second antenna.

16. An antenna arrangement as claimed in claim 1, wherein when the second antenna is in the non-extended position, the first antenna and the second antenna couple by electromagnetic coupling between the said antennas.

17. An antenna arrangement as claimed in claim 1, further comprising a housing, wherein the first antenna is fixed relative to the housing.

* * * * *